US006889462B1

(12) United States Patent
Carlson

(10) Patent No.: US 6,889,462 B1
(45) Date of Patent: May 10, 2005

(54) HARMONIC STABILIZER SYSTEM FOR RIFLE BARREL AND A RIFLE EQUIPPED THEREWITH

(75) Inventor: Paul Mark Carlson, Meadville, PA (US)

(73) Assignee: Robert M. Bayer, Meadville, PA (US), part interest ( * ) Notice: Subject to any disclaimer, the term of this patent is extended or adjusted under 35 U.S.C. 154(b) by 87 days.

(21) Appl. No.: 10/655,875

(22) Filed: Sep. 5, 2003

(51) Int. Cl.[7] ..... F41A 21/00

(52) U.S. Cl. ..... 42/75.01; 42/76.01; 89/14.05; 89/14.3

(58) Field of Search ..... 42/71.01, 75.01, 42/76.01; 89/14.05, 14.3

(56) References Cited

U.S. PATENT DOCUMENTS

| | | | | |
|---|---|---|---|---|
| 3,340,641 | A * | 9/1967 | Recker | 42/97 |
| 5,247,758 | A * | 9/1993 | Mason | 42/75.02 |
| 5,279,200 | A * | 1/1994 | Rose | 89/14.3 |
| 5,423,145 | A * | 6/1995 | Nasset | 42/75.01 |
| 5,661,255 | A * | 8/1997 | Webb, III | 89/14.05 |
| 6,196,108 | B1 * | 3/2001 | Murello | 89/44.02 |
| 6,497,170 | B1 * | 12/2002 | Kathe | 89/14.3 |
| 2002/0020403 | A1 * | 2/2002 | Troubridge | 124/89 |

* cited by examiner

*Primary Examiner*—J. Woodrow Eldred
(74) *Attorney, Agent, or Firm*—Richard K. Thomson

(57) ABSTRACT

A spring, which may be either a coil spring or a leaf spring, provides an adjustable stabilization force to the barrel of a rifle to tune out harmonic vibrations resulting from firing a particular bullet from the weapon. This tuning enables the scatter pattern for any bullet fired from any rifle to be significantly tightened from the resultant improved accuracy of the weapon.

20 Claims, 7 Drawing Sheets

HARMONIC STABILIZER SYSTEM FOR RIFLE BARREL AND A RIFLE EQUIPPED THEREWITH

BACKGROUND AND SUMMARY OF THE INVENTION

The present invention is directed to a device for improving accuracy of a rifle. More particularly, the present invention is directed to a harmonic stabilizer system for reducing vibration of a rifle barrel, thereby, reducing scatter, and to a rifle equipped with such a system.

Whether target shooting or hunting, a rifleman wants consistent, accurate shot placement; i.e., she/he wants to hit that at which she/he is shooting. A variety of factors can influence accuracy including windage, fatigue, ability, and harmonic vibration. The rifleman has no control over a number of these factors. It is the purpose of this invention to remove harmonic vibration from the group of factors which are not controllable. A number of attempts have been made to cope with this problem including hanging weights on the end of the barrel and employing an energy storage device. These attempts have met with only limited success and, in that they are typically bulky, generally, negatively contribute to the fatigue factor.

It has been determined that by installing a spring means between the barrel and the stock, a particular rifle using a particular bullet can be tuned to its "sweet spot" significantly reducing shot scatter problems caused by harmonic vibration. The present invention comprises a harmonic stabilizer system for a rifle barrel including spring means having a first end attached to a section of a stock ahead of a recoil lug; adjustment means engaging said spring means to adjust a level of stabilization force applied by a second end of said spring means against the rifle barrel; whereby said stabilizer system can be tuned for a particular rifle and bullet combination to greatly reduce shot scatter introduced by vibration of the rifle barrel during firing.

In one embodiment, a coil spring is used. In the preferred embodiment, a contoured leaf spring is employed and an adjustable screw mounted in the stock is used to adjustably increase the level of stabilization force applied against the barrel. While the leaf spring may be made of a number of materials (including plastic), it is preferably made of spring steel having a thickness of between 0.018 and 0.024 inches. Spacers can be mounted in the stock to provide thread engagement for both the attachment and adjustment screws. The spring is preferably contoured into a curved shape which has a reverse camber adjacent its free end to enhance the surface area engagement with the barrel. The engagement end can be fitted with a pad to interface between the spring and the barrel, the pad being made of a material selected from the group consisting of NAVCOM, another elastomer, and shrink tubing. While it is possible that the spring may be positioned anywhere between the recoil lug and the forward end of the stock, it is believed that the optimum location is toward the trailing end of the barrel where there will be less influence from thermal expansion.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1A:
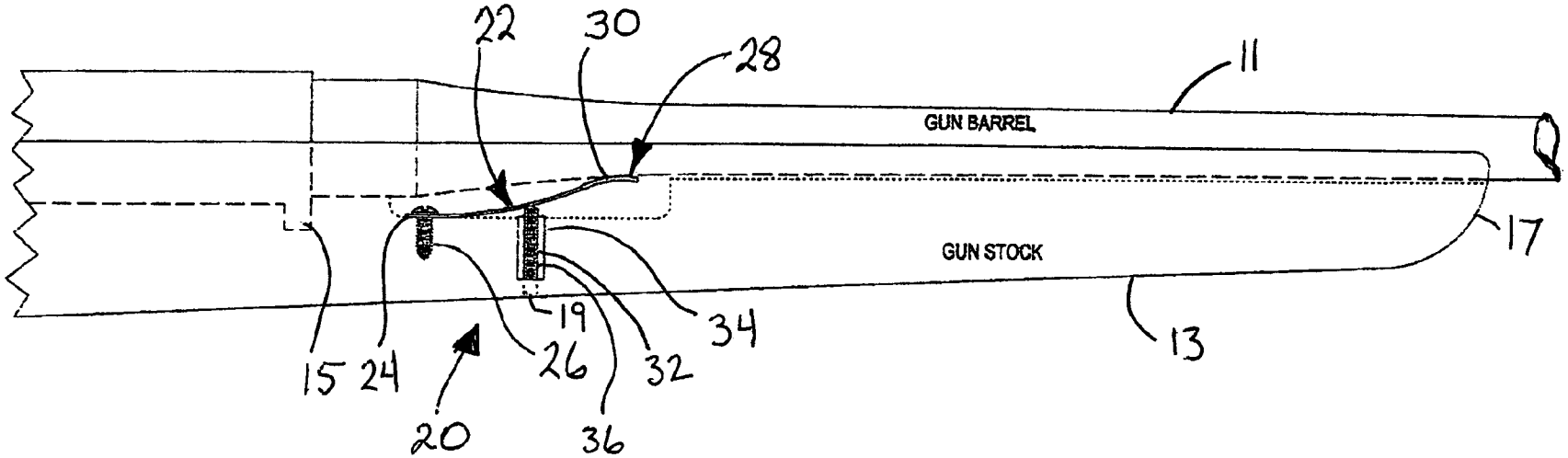
FIG. 1A is a side view of a first embodiment of the harmonic stabilizer of the present invention mounted on a rifle.

A first embodiment of the harmonic stabilizer system of the present invention is shown in FIG. 1A generally at 20. Harmonic stabilizer system 20 comprises spring means 22 positioned between the rifle barrel 11 and the stock 13 between the recoil lug 15 and the end of the stock 17. While the spring means 22 can be made of a variety of materials including some high strength plastics, in this embodiment, spring means 22 preferably comprises a leaf spring manufactured of spring steel which has a thickness in the range between 0.018 and 0.024 inches. This spring thickness is appropriate for conventional sports rifles. Thinner spring stock could be used with thinner barrels. A first end 24 of spring means 22 is secured to stock 13 by attachment screw 26. Spring means 22 is contoured into an arcuate shape with a reverse camber tip portion on the second end 28 thereof to enlarge a size of a contact region with the rifle barrel 11. Harmonic stabilizer system 20 further comprises adjustment means 32, in this embodiment, a set screw, which abuts spring means 22 and adjusts the stabilizing force administered to the rifle barrel 11. Access port 19 enables an Allen wrench, or the like, to be used to increase/decrease the force applied by spring means 22 to rifle barrel 11 by rotating screw 32 in threaded sleeve 34. Locking screw 36 snugged up against adjustment screw 32 prevents undesired loosening of the adjustment. Shrink tubing 30 is attached to second end 28 of spring means 22 providing additional damping of vibration.

Figure 3A:
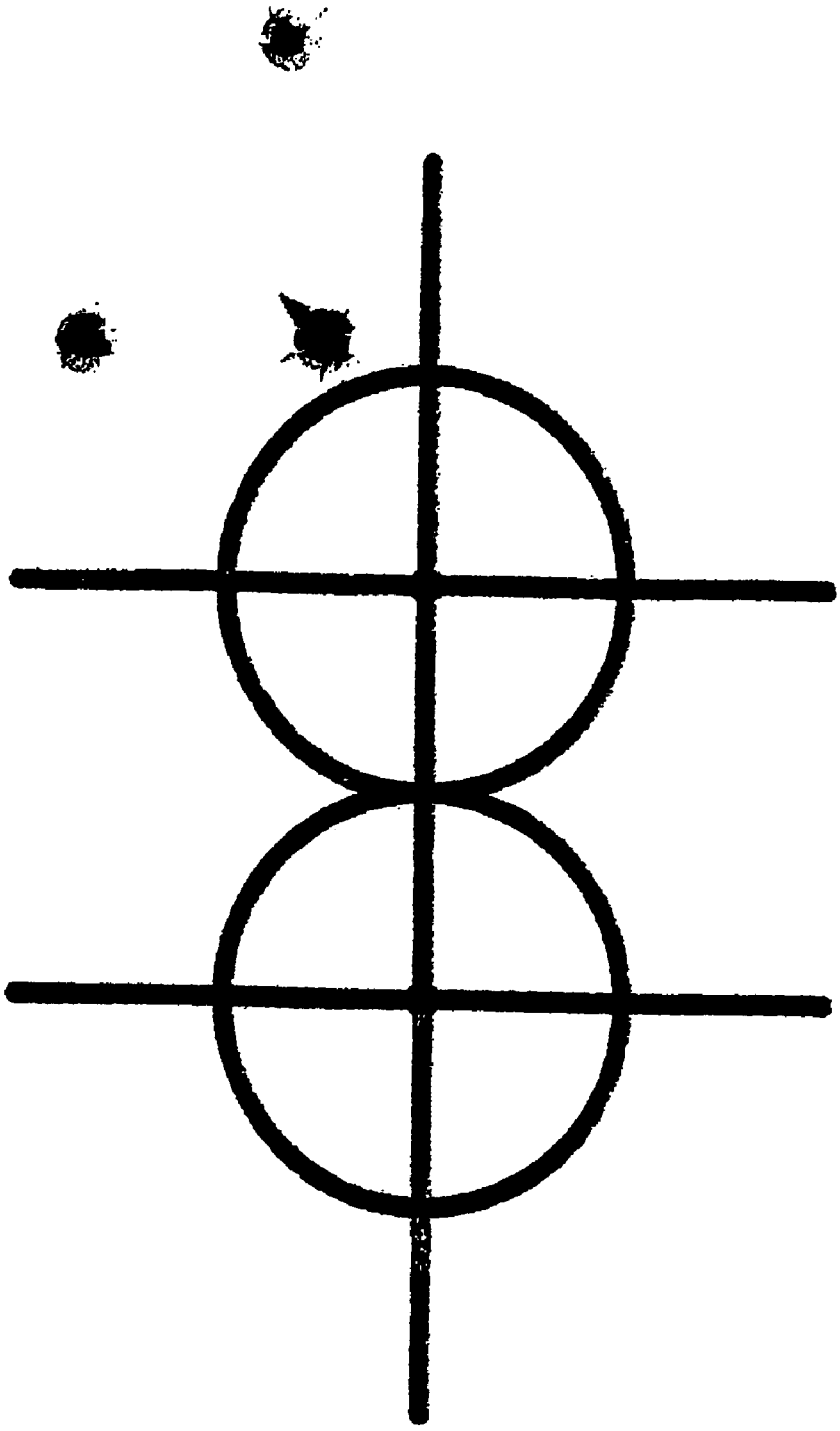
FIG. 3A is a diagram showing the original scatter pattern for one weapon.
Figure 3B:
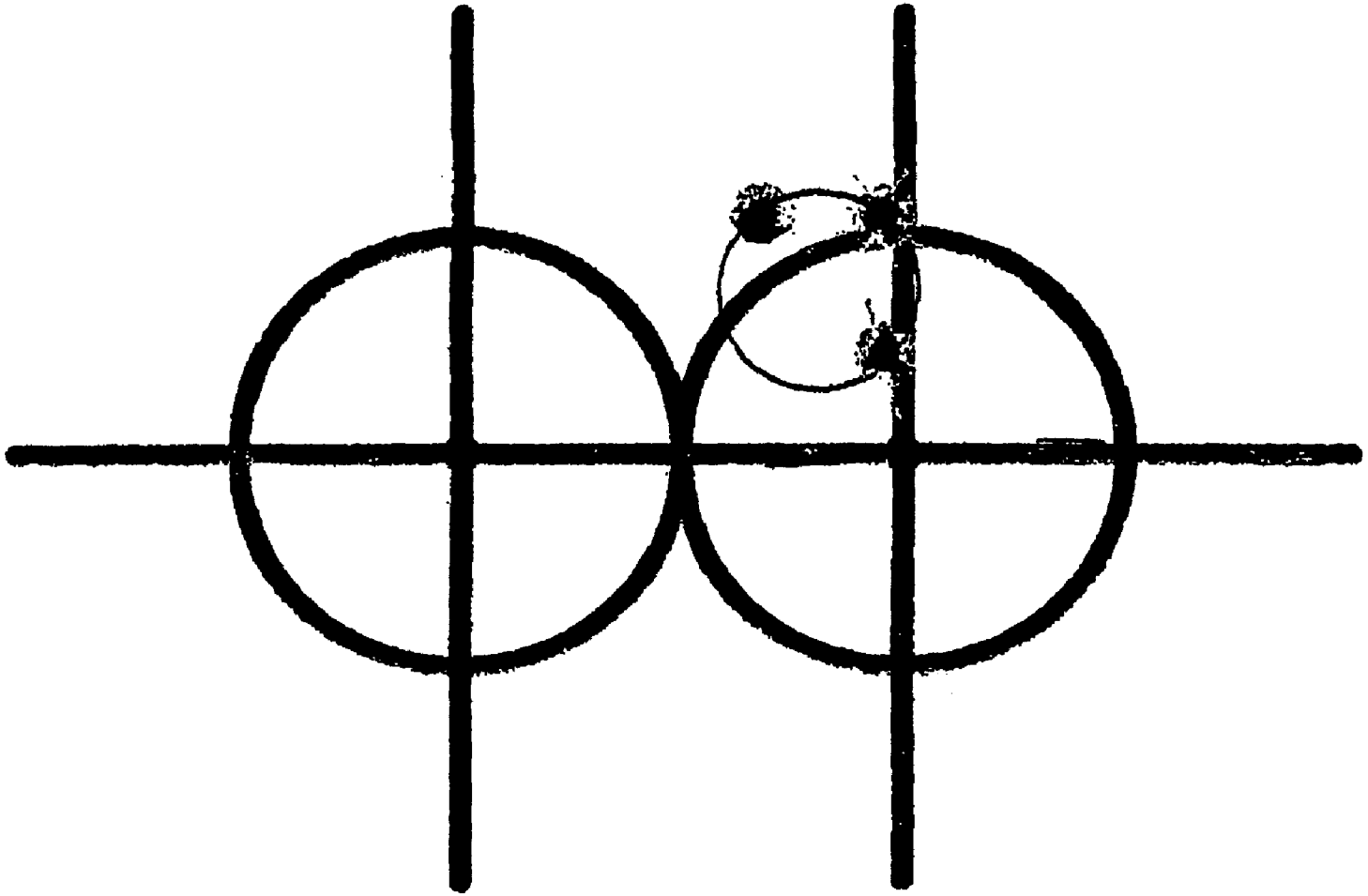
FIG. 3B is a diagram showing the scatter pattern for a rifle equipped with the harmonic stabilizer of the present invention tuned to its sweet spot.

A 300 Winchester magnum equipped with the FIG. 1A embodiment was used to fire 180 grain Spitzer bullets available from Nosler, Inc. in the FIGS. 3A and 3B tests. No stabilizing force was applied in the FIG. 3A shoot, accounting for the fairly broad scatter pattern. Each of the weapons used in these tests were fired from a test stand in order to remove, as much as possible, the human factors from the mix. The shot patterns were obtained in each instance without allowing the barrels to cool between successive shots in order to simulate, as closely as possible, actual firing conditions. In FIG. 3B, spring means 22 was adjusted to near the "sweet spot", i.e., the system was close to being tuned to provide optimum performance with this load in this weapon.

A second embodiment of the harmonic stabilizer of the present invention is depicted in FIG. 2B generally at 20A. In this second embodiment, the tip 28A has a pad 30A of NAVCOM material (this trademark is an acronym for noise and vibration control material which is made from a SORBOTHANE elastomer, and is available from Sims Vibration Laboratories) adhesively bonded thereto. This elastomeric material further damps the vibration of the rifle barrel 11A caused by the explosion resulting from firing the weapon.

Figure 1B:
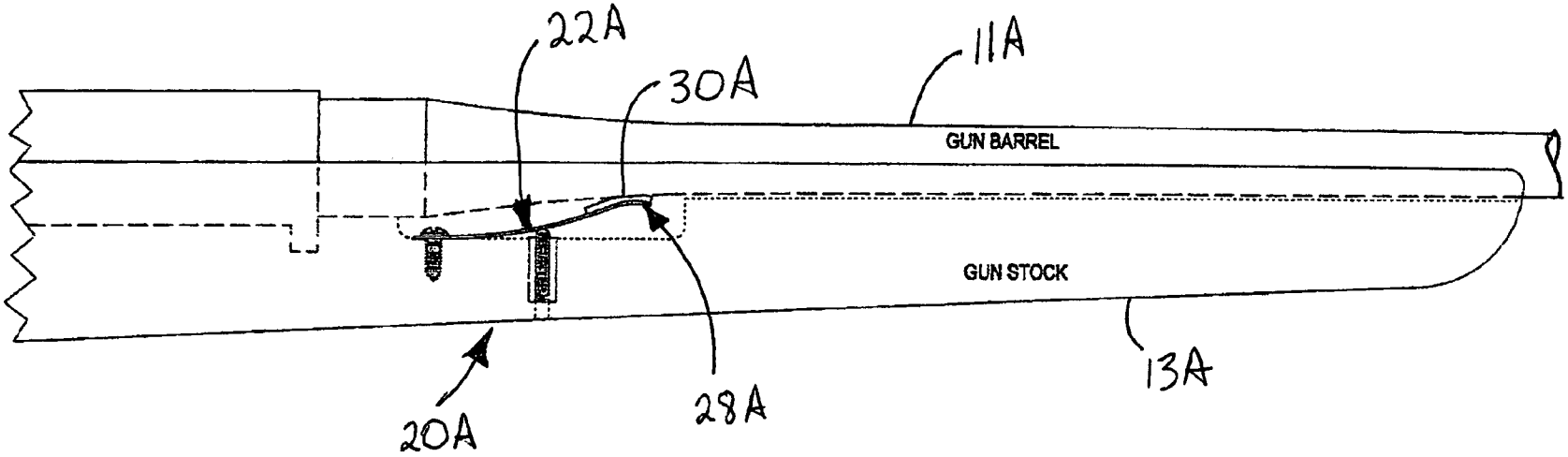
FIG. 1B is a side view of a second embodiment mounted in operative position.
Figures 4A, 4B, 4C, 4D:
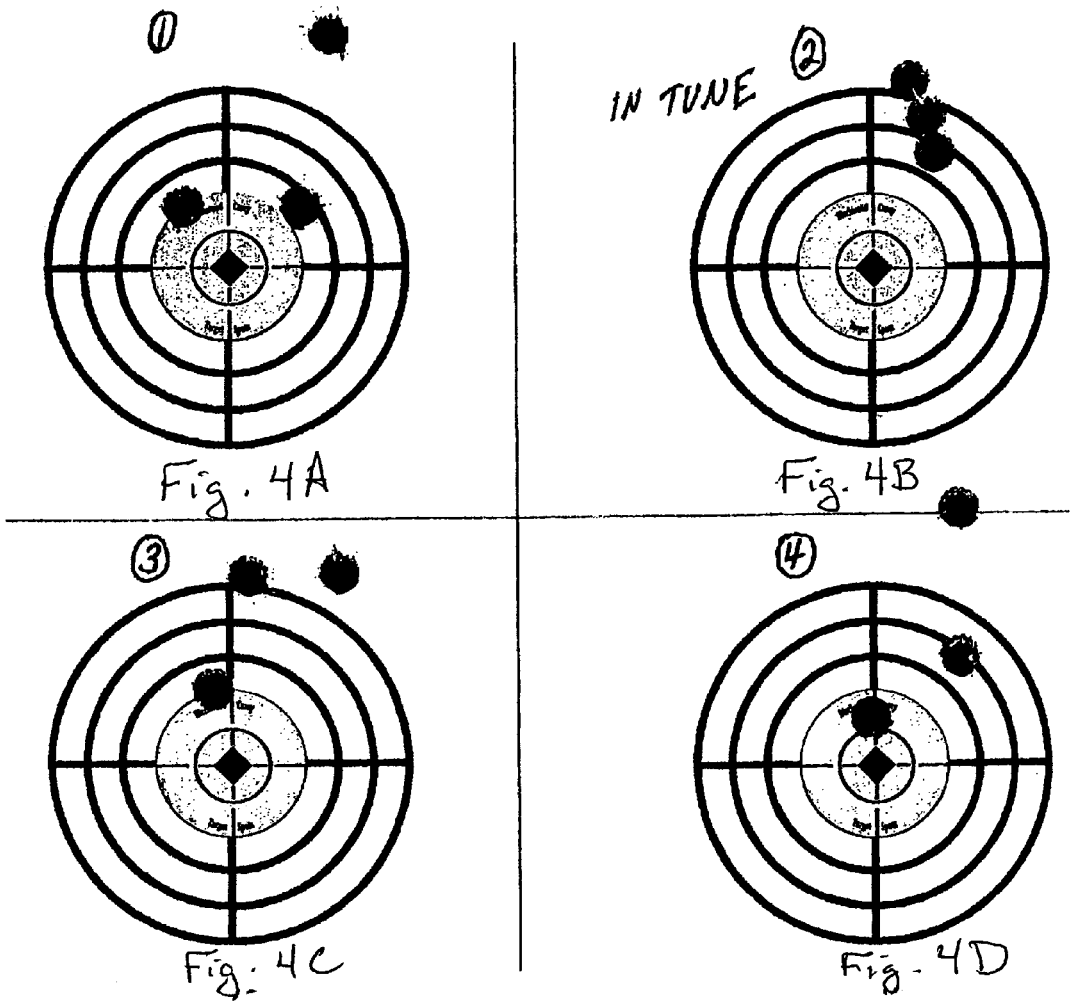
FIG. 4A is a diagram showing the scatter pattern for a second undamped rifle.
FIG. 4B is a diagram showing the scatter pattern for the second rifle tuned to its sweet spot.
FIG. 4C is a diagram showing the scatter pattern for the rifle providing additional spring force.
FIG. 4D is a diagram showing the scatter pattern for the rifle with additional spring force.

A 270 Winchester equipped with the FIG. 1B embodiment was tested firing 130 grain SST bullets available from Hornady Manufacturing. The results appear in FIGS. 4A–4D. In FIG. 4A, no stabilizing pressure was applied to the barrel 11A. In FIG. 4B, the rifle was tuned for this load and provided a very tight scatter pattern. The adjustment screw 32 was turned an additional ¼ turn past the position shown in FIG. 4B to determine what difference additional force might make. As can be seen in FIG. 4C, this application resulted in a destabilization of the harmonic damping which was achieved in FIG. 4B. As a cross check, an additional ¼ turn was applied beyond the FIG. 4C adjustment to produce the FIG. 4D results. As FIG. 4D shows, applying this amount of excessive force produces substantially the same results as the original scatter pattern of the weapon/load combination in FIG. 4A. This demonstrates the critical importance of tuning; applying excessive force using the harmonic stabilizer system 20A of the present invention will produce little, if any, beneficial results.

Figure 1C:
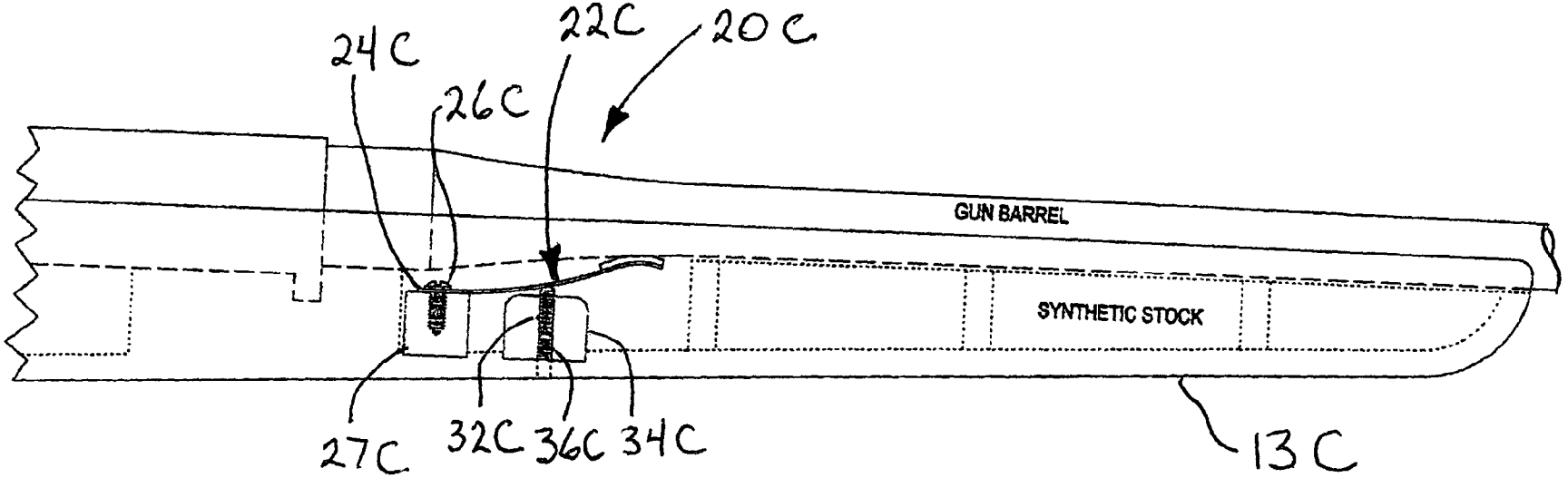
FIG. 1C is a side view of a third embodiment mounted in operative position.

A third embodiment of the harmonic stabilizer system of the present invention is shown in FIG. 1C generally at 20C. This embodiment is utilized with a synthetic stock 13C. Attachment spacer 27C is used to receive attachment screw 26C and to provide a reaction surface for first end 24C of spring 22C. Adjustment spacer 34C receives adjustment screw 32C and locking screw 36C.

Figure 2:
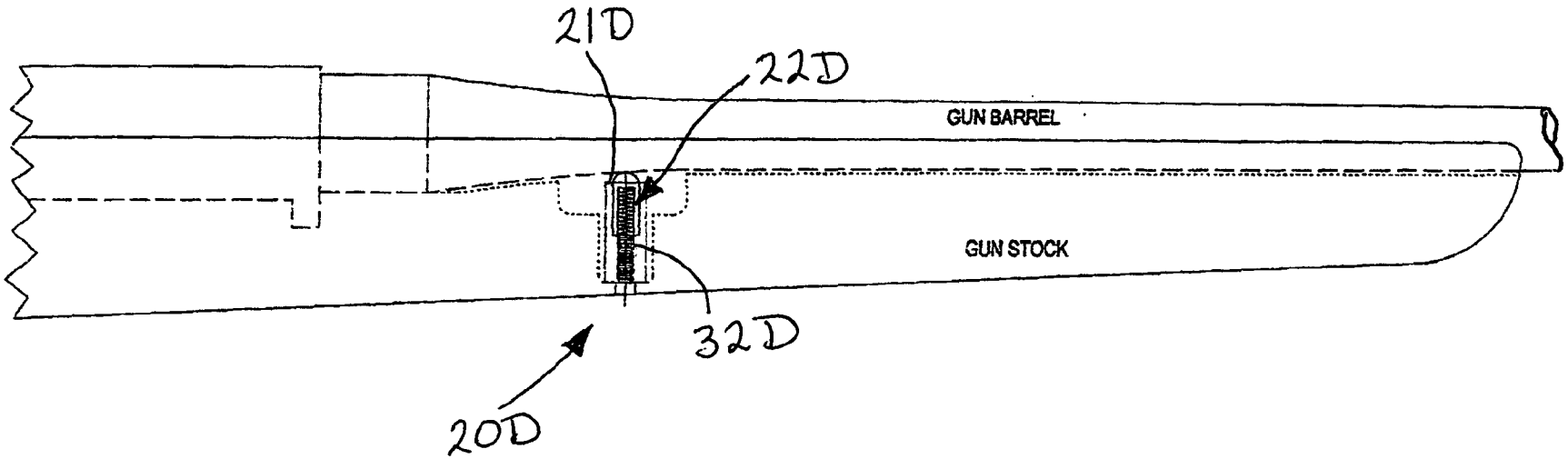
FIG. 2 is a side view of a fourth embodiment mounted in operative position.

A fourth embodiment of the harmonic stabilizer system of the present invention is shown in FIG. 2 generally at 20D. In this embodiment spring means 22D comprises a coil spring with a cap 21D and adjustment means is, once again, a set screw 32D. While a coil spring will work, it limits the placement of the spring means since the device including the attachment is so linear. The length of the spring means 22D necessitates mounting on the portion of the stock thick enough to accommodate that length.

The harmonic stabilizer system 20 of the present invention permits the effects normally associated with the destabilizing created by the explosion of any particular bullet to be tuned out of the equation so that the scatter pattern for that combination of weapon and load can be tightened significantly improving accuracy. Harmonic stabilizer system 20 can be retrofit to existing weapons or included in OEM rifles.

Various changes, alternatives and modifications will become apparent to one of ordinary skill in the art following a reading of the foregoing specification. For example, by carving an oversized hole in the leaf spring, the apparatus of the present invention can be used with a muzzle-loaded rifle, the hole accommodating the ram rod in its stored position. It is intended that any such changes, alternatives and modifications as fall within the scope of the appended claims be considered part of the present invention.

I claim:

1. A harmonic stabilizer system for a rifle barrel comprising a) spring means having a first end attached to a section of a stock ahead of a recoil lug;

b) adjustment means engaging said spring means to adjust a level of stabilization force applied by a second end of said spring means against the rifle barrel;

whereby said stabilizer system can be tuned for a particular rifle and bullet combination to greatly reduce shot scatter introduced by vibration of the rifle barrel during firing.

2. The harmonic stabilizer system of claim 1 wherein said spring means comprises a coil spring.

3. The harmonic stabilizer system of claim 1 wherein said spring means comprises a leaf spring.

4. The harmonic stabilizer system of claim 3 wherein said leaf spring comprises a strip of spring steel having a thickness in the range between 0.018 and 0.024 inch.

5. The harmonic stabilizer system of claim 3 further comprising a spring attachment spacer with a threaded internal bore for receiving a spring attachment screw through said first end of said leaf spring.

6. The harmonic stabilizer of claim 3 wherein said leaf spring is contoured into an arcuate shape with a reverse camber tip portion on said second end thereof to enlarge a size of a contact region with the rifle barrel.

7. The harmonic stabilizer system of claim 6 wherein said tip portion has a pad attached thereto interfacing between said tip portion and the rifle barrel.

8. The harmonic stabilizer system of claim 7 wherein said pad is made of an elastomeric material.

9. The harmonic stabilizer system of claim 1 wherein said adjustment means comprises an adjustable screw mounted in a portion of the stock upstream of said second end engaging the portion of the rifle barrel.

10. The harmonic stabilizer system of claim 9 further comprising a spacer with an internal thread receiving said adjustable screw, said spacer being mounted in a portion of the stock.

11. The harmonic stabilizer system of claim 1 wherein said portion of the rifle barrel engaged by said spring means comprises a rear portion of the barrel.

12. A rifle capable of improved shot scatter pattern comprising a) a stock;

b) a rifle barrel having a first trailing end and a second forward end;

c) a harmonic stabilizer system for a rifle barrel including i) spring means having a first end attached to a section of said stock ahead of a recoil lug;

ii) adjustment means engaging said spring means to adjust a level of stabilization force applied by a second end of said spring means against said rifle barrel;

whereby said stabilizer system can be tuned for a particular rifle and bullet combination to greatly reduce shot scatter introduced by vibration of said rifle barrel during firing.

13. The rifle of claim 12 wherein said portion of said rifle barrel engaged by said spring means comprises a rear portion.

14. The rifle of claim 12 wherein said spring means comprises a coil spring.

15. The rifle of claim 12 wherein said spring means comprises a leaf spring.

16. The rifle of claim 5 wherein said leaf spring comprises a strip of spring steel having a thickness in the range between 0.018 and 0.024 inch.

17. The rifle of claim 15 further comprising a spring attachment spacer with a threaded internal bore for receiving a spring attachment screw through said first end of said leaf spring.

18. The rifle of claim 15 wherein said leaf spring is contoured into an arcuate shape with a reverse camber tip portion on said second end thereof to enlarge a size of a contact region with the rifle barrel.

19. The rifle of claim 18 wherein said tip portion has a pad attached thereto interfacing between said tip portion and the rifle barrel.

20. The rifle of claim 19 wherein said pad is made of an elastomeric material.

* * * * *